US005935089A

United States Patent [19]

Shimizu

[11] Patent Number: 5,935,089

[45] **Date of Patent: *Aug. 10, 1999**

[54] TAPPING-TYPE MASSAGING MECHANISM AND MASSAGE DEVICE CONTAINING THE SAME

[75] Inventor: Nobuzo Shimizu, Higashi-Osaka, Japan

[73] Assignee: Daito Electric Machine Industry Company Limited, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/859,842

[22] Filed: May 21, 1997

[30] Foreign Application Priority Data

Dec. 6, 1996 [JP] Japan ..... 8-327134
Apr. 4, 1997 [JP] Japan ..... 9-086306

[51] Int. Cl.[6] ..... A61H 23/02

[52] U.S. Cl. ..... 601/111; 601/98; 601/103; 601/104

[58] Field of Search ..... 601/28–31, 49, 601/51, 53, 54, 70, 72, 78–80, 82, 86, 87, 90, 93, 95, 98, 101, 103–4, 107–111

[56] References Cited

U.S. PATENT DOCUMENTS 3,626,934 12/1971 Andis ..... 601/111
3,732,860 5/1973 Thurmer ..... 128/33
5,411,469 5/1995 Wang ..... 601/92
5,573,500 11/1996 Katsunuma et al. ..... 601/111
5,716,331 2/1998 Chang ..... 601/50

FOREIGN PATENT DOCUMENTS 2521082 9/1988 Japan .

*Primary Examiner*—Danton D. DeMille
*Attorney, Agent, or Firm*—Birch, Stewart, Kolasch & Birch, LLP

[57] ABSTRACT

A tapping-type massaging mechanism includes a drive motor; a support plate secured to the drive motor so as to extend radially outwardly of the motor; a crank pin eccentrically secured to an output shaft of the drive motor; an elastically deformable connecting member secured to the support plate at one end thereof so as to extend in the same direction as the output shaft; a vibrating plate secured to the other end of the connecting member so as to be movable relative to and in parallel with the support plate, the vibrating plate receiving therethrough the crank pin for rotation; and a tap-massaging member mounted on an end of the vibrating plate so as to orient toward a direction orthogonal to the output shaft.

14 Claims, 12 Drawing Sheets

TAPPING-TYPE MASSAGING MECHANISM AND MASSAGE DEVICE CONTAINING THE SAME

BACKGROUND OF THE INVENTION

1. Field of the Invention

The present invention relates to a tapping-type massaging mechanism and a massage device containing the same.

2. Description of the Prior Art

A hand-carriable massage device containing such a tapping-type massaging mechanism is proposed in, for example, Japanese Patent No. 2521082 in which rotary movement of a drive motor is converted into vibration of a vibrating plate through a crank mechanism so as to cause massaging heads mounted on the vibrating plate to perform a tapping operation.

Such a conventional massage device comprises a housing with a grip, a drive motor housed in the housing, a vibrating plate provided with massaging heads projecting outwardly of the housing, and a crank pin disposed eccentrically with the output shaft of the drive motor.

In the conventional device, the vibrating plate is pivotally attached at a central portion thereof to the housing and connected at an end portion thereof to one end of a crank connecting rod which in turn is connected at the other end thereof to the crank pin, so that rotation of the output shaft will be converted into vibration of the vibrating plate.

Since the vibrating plate is pivoted on the housing, looseness is likely to result at the pivoted point during long-term use, thus raising a problem in durability.

The conventional device is adapted to convert the rotation of the output shaft into rectilinear motion of the crank rod and then into vibration of the vibrating plate. This makes the interior structure of the device relatively complicated. Further, the device requires a stiff crank connecting rod to vibrate the vibrating plate with appropriate intensity, thus resulting in costly manufacture.

SUMMARY OF THE INVENTION

In view of the above situation, an object of the present invention is to provide a less costly tapping-type massage device with enhanced durability in which a vibrating plate is not pivoted on a housing and is capable of vibrating without requiring any stiff crank connecting rod.

To fulfill the above object, the present invention provides the following technical means.

Specifically, there is provided a tapping-type massaging mechanism wherein: a support plate is secured to a drive motor; an elastically deformable connecting member projecting in the same direction as an output shaft of the motor is secured at its one end to the support plate; the other end of the elastically deformable connecting member is secured to a vibrating plate such that the vibrating plate is movable relative to and in parallel with the support plate; a crank pin is eccentrically secured to the output shaft of the motor while rotatably extending through the vibrating plate; a tap-massaging member is mounted on an end portion of the vibrating plate so as to orient orthogonally to the output shaft.

In this arrangement, when the drive motor is actuated, the crank pin eccentrically secured to the output shaft is caused to rotate thereby vibrating the vibrating plate. The vibration of the vibrating plate causes the tap-massaging member to perform tapping.

Thus, the tap-massaging member can perform tapping without the necessity of pivotally mounting the vibrating plate on the housing and of using a stiff crank connecting rod as in the conventional device.

In the present invention, where a ball bearing is provided in the vibrating plate to allow the crank pin to extend therethrough, the crank pin is enabled to smoothly rotate relative to the vibrating plate, whereby rotational force of the output shaft of the drive motor is efficiently converted into vibration of the vibrating plate.

The number of the massaging member is not limited insofar as the massaging member has one or more massaging heads.

In an arrangement where the massaging member includes a pair of right and left massaging heads, it is preferable that the crank pin is inserted through the vibrating plate centrally of the width of the vibrating plate, and the pair of right and left massaging heads oriented toward the same direction are disposed on the right and left sides, respectively, of the vibrating plate in terms of its widthwise direction so as to be spaced substantially equidistantly from the point through which the crank pin is inserted.

Since the distances from the crank pin to the respective massaging heads are substantially equal, the two heads tap with a substantially equal force, thereby providing suitable tapping massage.

In the present invention, the elastically deformable connecting member is used to interconnect the vibrating plate and the support plate such that the vibrating plate is movable relative to and in parallel with the support plate within the range of the eccentric movement of the crank pin. Hence, the elastically deformable connecting member can be formed of, for example, a synthetic resin having elasticity such as rubber, a coiled spring or the like so long as it serves the purpose.

Since the vibrating plate directly connected to the crank pin causes the massaging heads to tap, if the vibrating plate entirely moves following the movement of the crank pin, the massaging heads are caused to move not only in the tapping direction but also in the direction orthogonal to the tapping direction, leading to undesirable results for this type of massage device.

More specifically, since the massaging heads outwardly extend through openings defined in the housing as described below, such openings are required to be made unreasonably large if the massaging heads largely move in the direction orthogonal to the tapping direction. As a result, foreign matters such as dust are likely to penetrate into the housing.

To obviate such problem, it is recommended in this invention to employ a connection structure for interconnecting the vibrating plate and the support plate such that the massaging heads are allowed to move in the tapping direction but inhibited from moving in the direction orthogonal to the tapping direction as much as possible.

One example of such connection structure is realized by linearly disposing a plurality of columnar members as the elastically deformable connecting member in the direction orthogonal to the tapping direction of the massaging heads.

In this case, each columnar member may be formed to have a greater thickness in the direction orthogonal to the tapping direction than in the tapping direction, whereby the massaging heads are hard to move in the direction orthogonal rather than in the tapping direction.

Alternatively, the connection structure is implemented by employing as the elastically deformable connecting member an elongate strip member having a longer side in the direction orthogonal to the tapping direction of the massaging heads.

Though the elastically deformable connecting member can be disposed at any position which allows the vibrating plate to be supported for free movement in the plane thereof(inplane direction), it is preferred that any one of the plurality of the columnar members be disposed at a widthwise position of the vibrating plate corresponding to the massaging head mounting position of the vibrating plate.

In this preferred arrangement, the elastically deformable connecting member directly supports the vibrating plate at an area adjacent the massaging head, thereby restraining vibration of such area of the vibrating plate in the thicknesswise direction (out-of-plane direction) of the vibrating plate. Accordingly, the rotation of the output shaft is wholly and properly converted into vibration of the vibrating plate in the in-plane direction, thereby efficiently allowing the massaging heads to perform tapping.

The massaging head may be undetachably fixed to the vibrating plate. However, where the head is detachably secured to the vibrating plate, the tapping can be adjusted by, for example, replacing a hard head with a soft head and vice versa, thereby providing various massaging effects.

In this invention, it is further recommended that the massaging head is secured to the vibrating plate through a mounting bracket which is secured to the vibrating plate so as to extend toward the drive motor side.

In this case, the massaging head need not be disposed away from the drive motor, thereby making the tapping-type massaging mechanism more compact.

The tapping-type massaging mechanism of the present invention can be contained in any of the hand-carriable type and the stationary type massage devices.

A hand-carriable massage device containing the foregoing tapping-type massaging mechanism can be constructed by containing the massaging mechanism in a housing having one end forming a grip and the other end defining an opening in such a manner that the tap-massaging member is exposed through the opening.

A stationary type massage device containing the tapping-type massage mechanism can be constructed by containing the massaging mechanism in a stationary type housing having a foot rest surface and an opening on its top in such a manner that the tap-massaging member projects upward beyond the foot rest surface through the opening.

In the stationary type massage device, the present invention recommends that the housing comprise an open top housing body and a lid having an opening and covering the open top of the housing body, and that the tapping-type massaging mechanism be secured to the lid on the underside thereof so as to be clear of the bottom of the housing body.

In this arrangement, rebound generated in the tapping-type massaging mechanism due to the vibration of the vibrating plate is transmitted to the housing body through the lid but not directly transmitted to the bottom plate of the housing body, thereby preventing the housing from leaping on the floor during the tapping operation.

In case that the tapping-type massaging mechanism is secured to the underside of the lid with insufficient strength, a support column may be fixed to the support plate of the mechanism as extending down to the bottom surface of the housing body through a shock-absorbing member.

In this case, the tapping-type massaging mechanism is supported also with the support column and, hence, the mounting strength of the mechanism is enhanced. In addition, the housing is prevented from leaping on the floor during the tapping operation by virtue of the shock-absorbing member through which the support column bears on the bottom surface of the housing body.

Further, if the column is disposed at a position of the support plate corresponding to the massaging head mounting position in the widthwise direction of the vibrating plate, the support column supports the support plate at an area which is most susceptible to the rebound caused by the tapping operation, thereby utilizing the shock-absorbing effect of the shock-absorbing member against the rebound more effectively.

The foregoing and other objects, features and attendant advantages of the present invention will be more fully appreciated from the reading of the following detailed description in conjunction with the attached drawings.

DESCRIPTION OF THE PREFERRED EMBODIMENTS

The present invention will now be described in detail with reference to the drawings.

Figure 1:
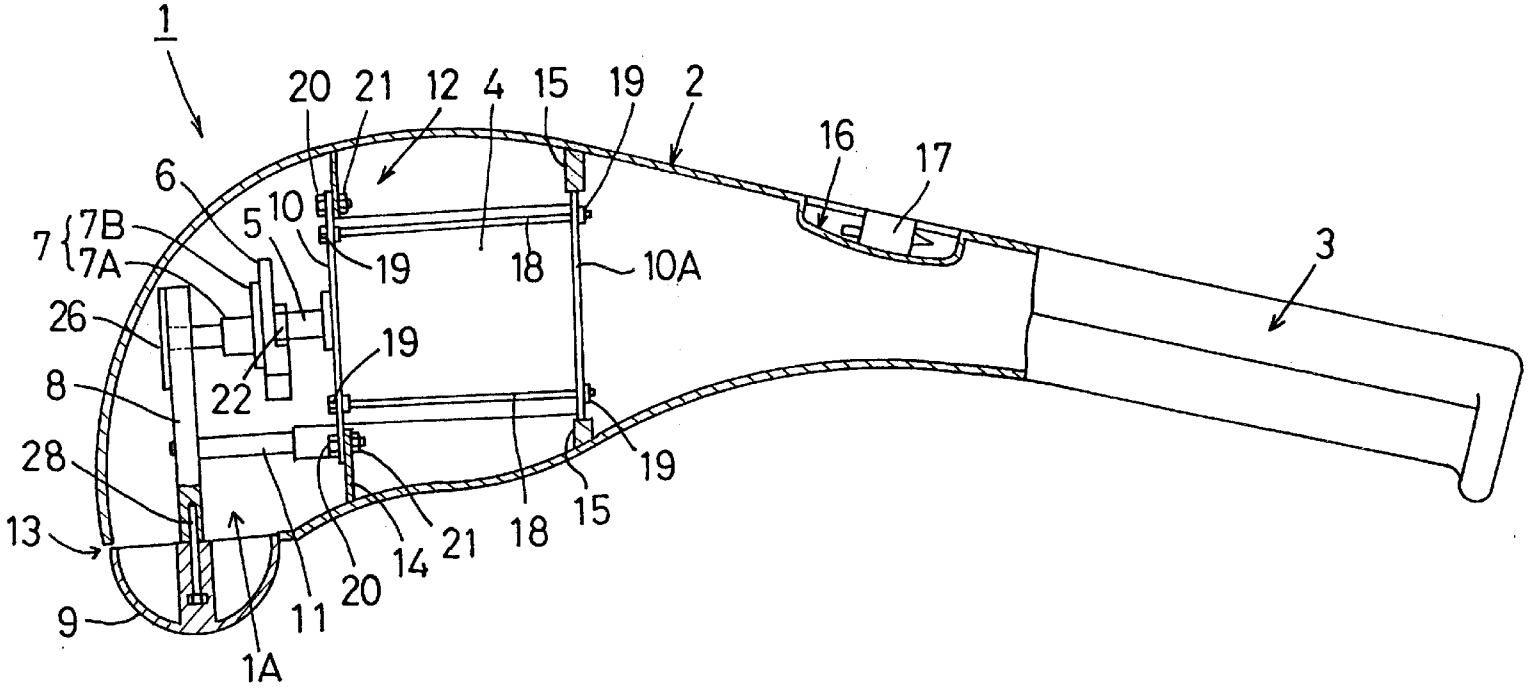
FIG. 1 is a partially cutaway side view showing the entire construction of a hand-carriable massage device embodying the present invention.
Figure 2:
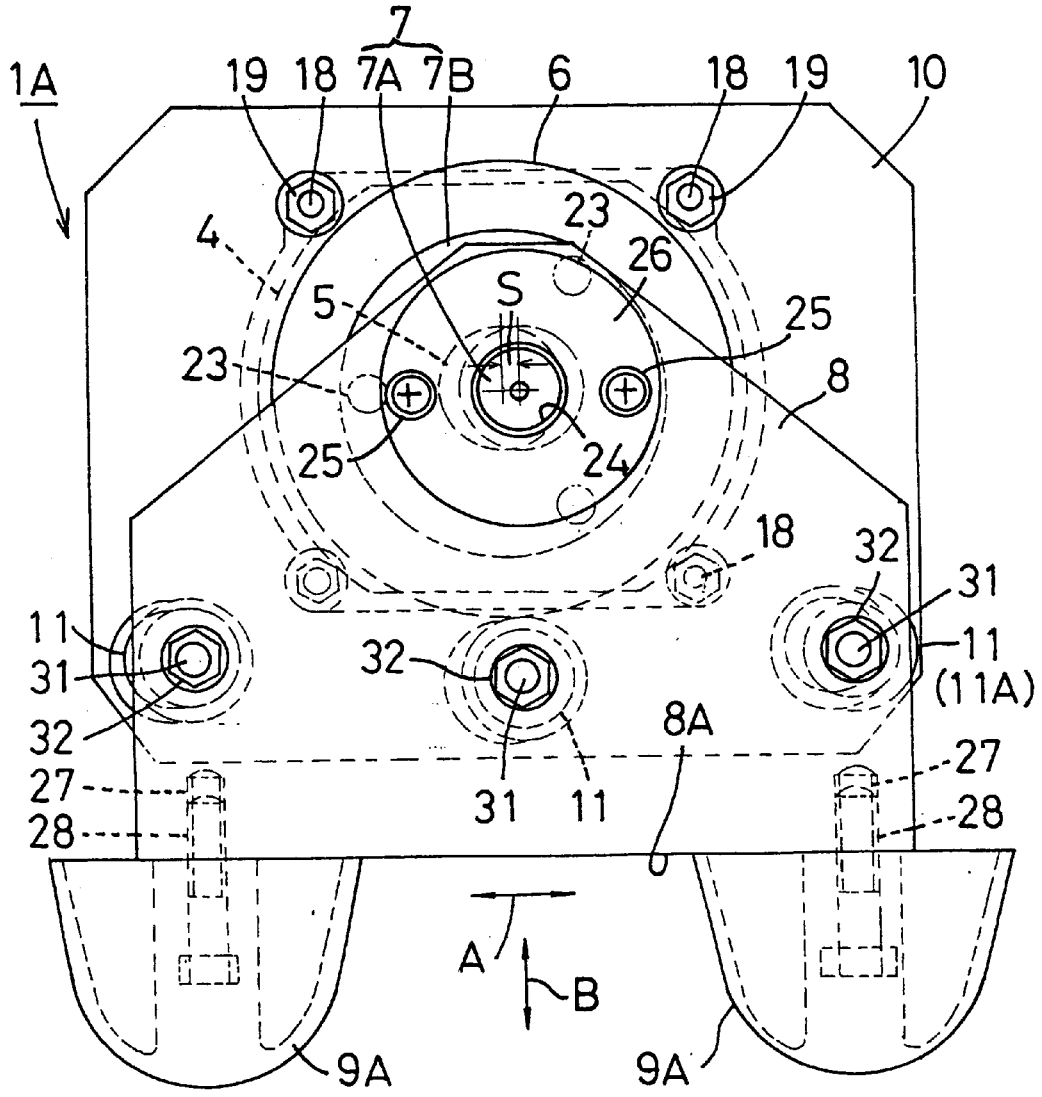
FIG. 2 is a front view showing a tapping-type massaging mechanism contained in the hand-carriable massage device shown in FIG. 1.
Figure 3:
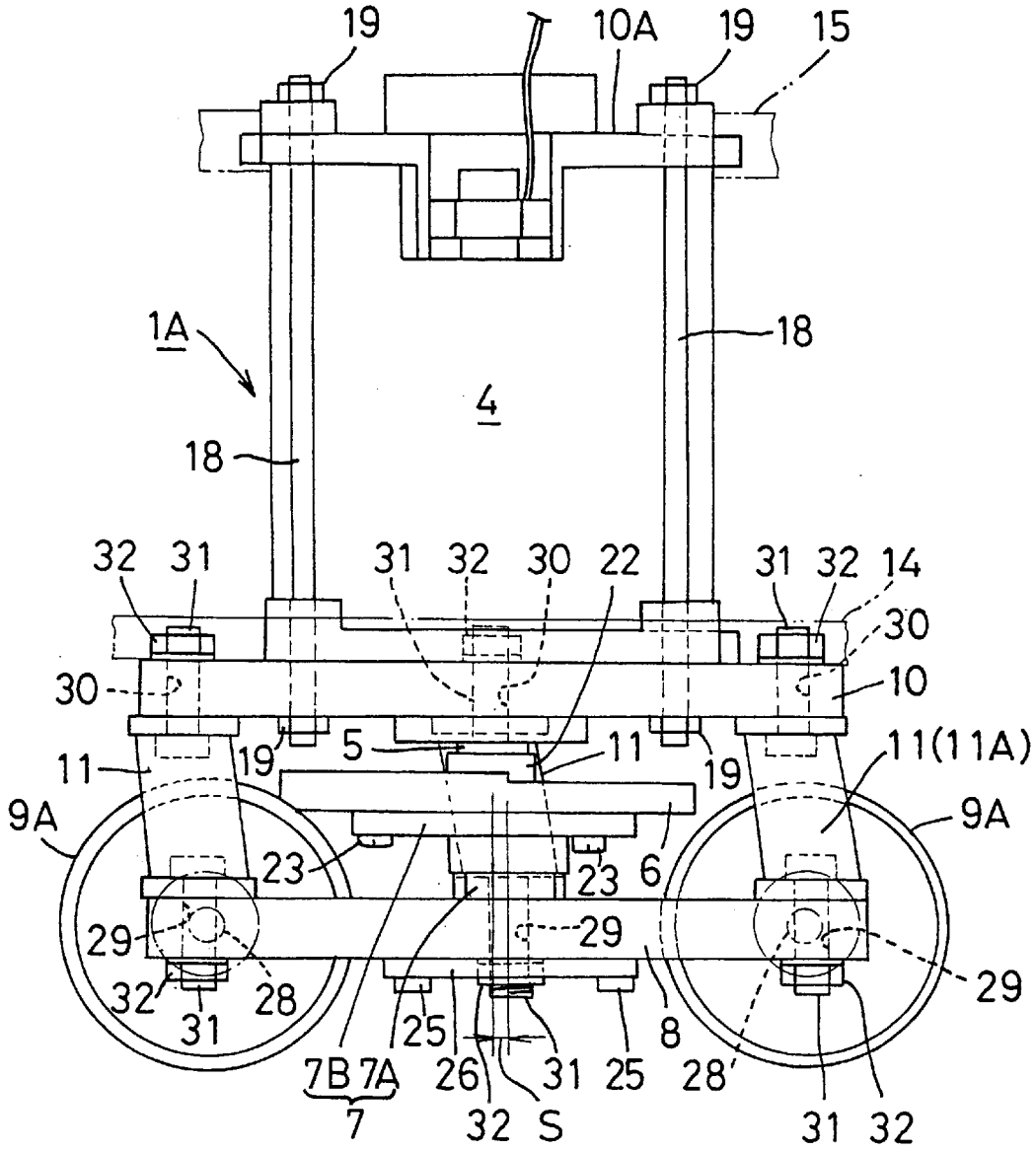
FIG. 3 is a top plan view of the tapping-type massaging mechanism shown in FIG. 2.

FIGS. 1 to 3 show a hand-carriable massage device 1 containing a tapping-type massaging mechanism 1A according to an embodiment of the present invention.

The massage device 1 comprises a housing 2 having one end forming an elongate grip 3 and the tapping-type massaging mechanism 1A contained in the housing 2.

The tapping-type massaging mechanism 1A includes an AC drive motor 4 fitted in the housing 2, a counterbalance 6 attached to output shaft 5 of the drive motor 4, a crank mechanism 7 attached to the counterbalance 6, and a vibrating plate 8 mounted on the crank mechanism 7 for rotation relative to the mechanism 7.

The tapping-type massaging mechanism 1A further includes a massaging member 9 mounted on the vibrating plate 8 and projecting out of the housing 2, a support plate 10 secured to a surface of the drive motor 4 on the output shaft 5 side, and elastic connecting members 11 interposed between the support plate 10 and the vibrating plate 8 so as to interconnect the plates 8 and 10 and allow the vibrating plate 8 to reciprocate.

The housing 2 is formed of a rigid synthetic resin such as a plastic and has one end forming the elongate grip 3 and the other end defining a chamber 12 for containing the tapping-type massaging mechanism 1A. The chamber 12 has on its distal side a side face defining an opening 13 oriented in a direction substantially orthogonal to the longitudinal direction of the grip 3 to allow a massaging head to project therethrough.

As shown in FIG. 1, in the chamber 12 of the housing 2 is provided with mounting plate 14 extending from a position adjacent the opening 13 and a motor fitting wall 15 on the grip 3 side. In the longitudinally central portion of the housing 2 is provided a switch containing portion 16 in which is provided a switch 17 for operating the drive motor 4 from the exterior. The housing 2 is formed by joining two half portions divided centrally of the thickness of the housing (vertical direction in FIG. 1), so that the tapping-type massaging mechanism 1A can be incorporated into the housing 2 without the necessity of disassembling the mechanism.

The drive motor 4 is interposed between the support plate 10 and mounting plate 10A abutting the motor on the output shaft 5 side and the opposite side thereof, respectively. These plates 10,10A are secured to the drive motor 4 by fastening long bolts 18 extending in the same direction as the output shaft 5 between the plates 10,10A with nuts 19 at opposite ends thereof.

The drive motor 4 attached the plates 10,10A is securely fixed in the chamber 12 by fitting the mounting plate 10A into the fitting wall 15 and fixing the support plate 10 to the mounting plate 14 with bolts 20 and nuts 21.

As shown in FIG. 3, the counterbalance 6 is in the form of disc having a boss 22 at the center thereof, and the boss 22 receives and is secured to the end of the output shaft 5. The counterbalance 6 is formed to be heavier on the side opposite to the eccentricity direction of a crank pin 7A of the crank mechanism 7 so as to prevent the rebound resulting from the vibration of the vibrating plate 8 from being directly transmitted to the support plate 10. Accordingly, although the crank pin 7A is eccentric with the axis of the output shaft 5, the counterbalance 6 maintains proper weight equilibrium thereby allowing the drive motor 4 to generate smooth rotary motion.

The crank mechanism 7 comprises the crank pin 7A and a disk-shaped eccentric ring 7B disposing the crank pin 7A on one surface thereof with a slight eccentricity S. The pin 7A and ring 7B are integrally formed of a rigid synthetic resin. The eccentric ring 7B is concentrically and removably mounted on the counterbalance 6 by means of a screws 23.

In FIG. 2, the vibrating plate 8 is a relatively thick plate formed of a rigid synthetic resin and having a shape composed of an upper trapezoidal portion and a lower rectangular portion as viewed from the front of FIG. 2. In a central portion of the upper trapezoidal portion of the vibrating plate 8 is incorporated a ball bearing 24 through which the crank pin 7A is inserted. The ball bearing 24 is prevented from coming off. by a ring 26 fixed to the vibrating plate 8 with a screws 25.

Instead of the ball bearing 24, one could employ a radial bearing or a thrust bearing.

The vibrating plate 8 has threaded holes 27 opened toward a direction orthogonal to the output shaft 5 at right and left ends of the lower edge thereof as viewed in FIG. 2. The threaded holes 27 removably receive screws 28 which are secured to massaging heads 9A by means of insert molding as described below. Holes 29 for mounting elastic connecting members 11 are defined at central position and right and left end positions in the lower rectangular portion of the vibrating plate 8.

In this embodiment, the massaging member 9 comprises a pair of right and left massaging heads 9A each having a substantially hemispherical shape and formed of a rigid plastic, rubber or the like. Each massaging head 9A has the aforementioned screw 28 shaped like a bolt. The screw 28 is insert molded with the corresponding massaging head 9A so as to project centrally of the head 9A. By threadingly engaging the screws 28 into the respective threaded holes 27, the massaging heads 9A are removably mounted on an edge of the vibrating plate 8 so as to orient in a direction orthogonal to the output shaft 5.

Since each of the massaging heads 9A is detachably attached to the vibrating plate 8 by screwing, various types of massaging heads 9A with different shapes or materials (hardness) can be prepared, and selected, as desired, to provide proper massage effect depending on the portion to be massaged of a user's body.

The support plate 10 is also a relatively thick plate formed of a rigid synthetic resin. The support plate 10 is secured to a surface of the drive motor 4 on the output shaft 5 side so as to radially outwardly extend therefrom as shown in FIGS. 2 and 3. In the support plate 10 are defined holes 30 for mounting the elastic connecting members 11 at positions corresponding to the holes 29 of the vibrating plate 8.

While not shown in FIG. 2, the support plate 10 defines bolt holes at positions corresponding to the bolt holes defined in the mounting plate 14 of the housing 2 for receiving the bolts 20.

According to this embodiment, the elastic connecting members 11 each comprises columnar member 11A formed of rubber having a suitable elasticity. The columnar member 11A is provided with mounting screws 31 secured at longitudinally opposite ends thereof. The securing of the mounting screws 31 can be achieved by, for example, insert molding bolts in the opposite end portions of each columnar member 11A. The mounting screws 31 of the column 11A are inserted through the holes 29,30 of the support plate 10 and vibrating plate 8 and fastened with nuts 32.

Each of the columnar members 11A (elastic connecting members 11) is fixed to the support plate 10 at one end thereof so as to extend in the same direction as the output shaft 5 and to the vibrating plate 8 at the other end. Thus, the vibrating plate 8 is connected to the support plate 10 through a plurality of columnar members 11A so as to be movable in parallel with and relative to the support plate 10.

Consequently, the vibrating plate 8 is supported so as to be movable relative to the support plate 10 within a range limited by radially outward elastic deformation of the columnar members 11A.

As shown in FIGS. 2 and 3, in the massaging mechanism 1A of this embodiment, the crank pin 7A is inserted through the vibrating plate 8 centrally of the width of the plate 8. The pair of right and left massaging heads 9A,9A oriented toward the same direction are disposed on the right and left sides, respectively, of the vibrating plate 8 in the widthwise direction so as to be spaced substantially equidistantly from the crank pin receiving position of the vibrating plate 8. The three columnar members 11A, as shown in FIG. 2, are substantially linearly aligned in the direction A which is orthogonal to the tapping direction B of the massaging heads 9A.

Further, the two of the columnar members 11A on the right and left sides are each disposed at positions on the vibrating plate 8 between the crank pin 7A and the edge 8A corresponding in the widthwise direction of the vibrating plate 8 to the mounting positions of the massaging heads 9A,9A.

In the hand-carriable massage device 1 containing the aforementioned tapping-type massaging mechanism 1A, when the switch 17 is turned ON to operate the drive motor 4, the counterbalance 6 and crank mechanism 7 secured to the output shaft 5 rotate, so that the crank pin 7A revolves about the axis of the output shaft 5. In response, the vibrating plate 8 is caused to vibrate in both the widthwise direction (direction A in FIG. 2) and the vertical direction (direction B in FIG. 2).

This results in movements of the massage heads 9A,9A fixed on the edge 8A of the vibrating plate 8 in the same directions as the vibration of the vibrating plate 8, i.e., both in the tapping direction B and the direction A orthogonal to the tapping direction B.

Since the pair of right and left massaging heads 9A,9A are disposed on the right and left sides, respectively, of the vibrating plate 8 in the widthwise direction so as to be spaced substantially equidistantly from the crank pin receiving position of the vibrating plate 8, the heads 9A,9A perform tapping with a substantially equalized force, thereby providing excellent massaging effect.

When applied on any desired portion of a human body, the massaging heads 9A,9A vibrating in the direction B tap the portion to provide massaging effect.

The strength of the tapping force may be changed by, for example, using a variable resistor in the power source of the drive motor 4 and varying the frequency of current.

In this embodiment, the two of the three columnar members 11A (elastic connecting members 11) on the right and left sides directly support portions of the vibrating plate 8 adjacent the massaging heads 9A,9A, thereby inhibiting the vibrating plate 8 from vibrating in the thicknesswise direction (in the direction toward and away from FIG. 2). Consequently, the rotary movement of the output shaft 5 is efficiently converted into the in-plate vibration of the vibrating plate 8, whereby the massaging heads 9A,9A efficiently perform tapping.

Further, since the three columnar members 11A of this embodiment are substantially linearly aligned in the direction orthogonal to the tapping direction of the massaging heads 9A,9A, the portions adjacent the massaging heads 9A,9A of the vibrating plate 8 are connected to the support plate 10 so as to be allowed to easily move in the tapping direction B but restrained from moving in the direction A orthogonal to the tapping direction B.

For this reason, the opening 13 defined in the housing 2 for the massaging heads 9A,9A to extend therethrough can be formed as small as possible thereby minimizing the penetration of foreign particles such as dust into the housing 2.

In this embodiment, the massaging member 9 may comprise one or more than two massaging heads 9A. The massaging heads 9A,9A may each be formed of a soft material such as rubber or formed with protrusions on the surface thereof. The massaging heads may be secured to the vibrating plate 8 through a shock-absorbing material such as rubber or springs.

The configuration of the vibrating plate 8 is not limited to that shown in FIG. 2. The vibrating plate 8 may be in any plate form which acts at least as a member for mounting the massaging heads, for example, an L-shape or an inverted T-shape. The vibrating plate 8 may be bent at the edge 8A thereof in the thickness direction thereof so as to expand the surface for mounting the massaging heads 9A,9A.

Further, the elastic connecting members 11 may each comprise an elastic member such as a coil spring instead of the rubber columnar member. The grip 3 may comprise a pair of right and left U-shaped grips provided on the exterior of the chamber 12 on the right and left sides of the massaging heads 9A instead of one elongate cylindrical grip.

Figure 4:
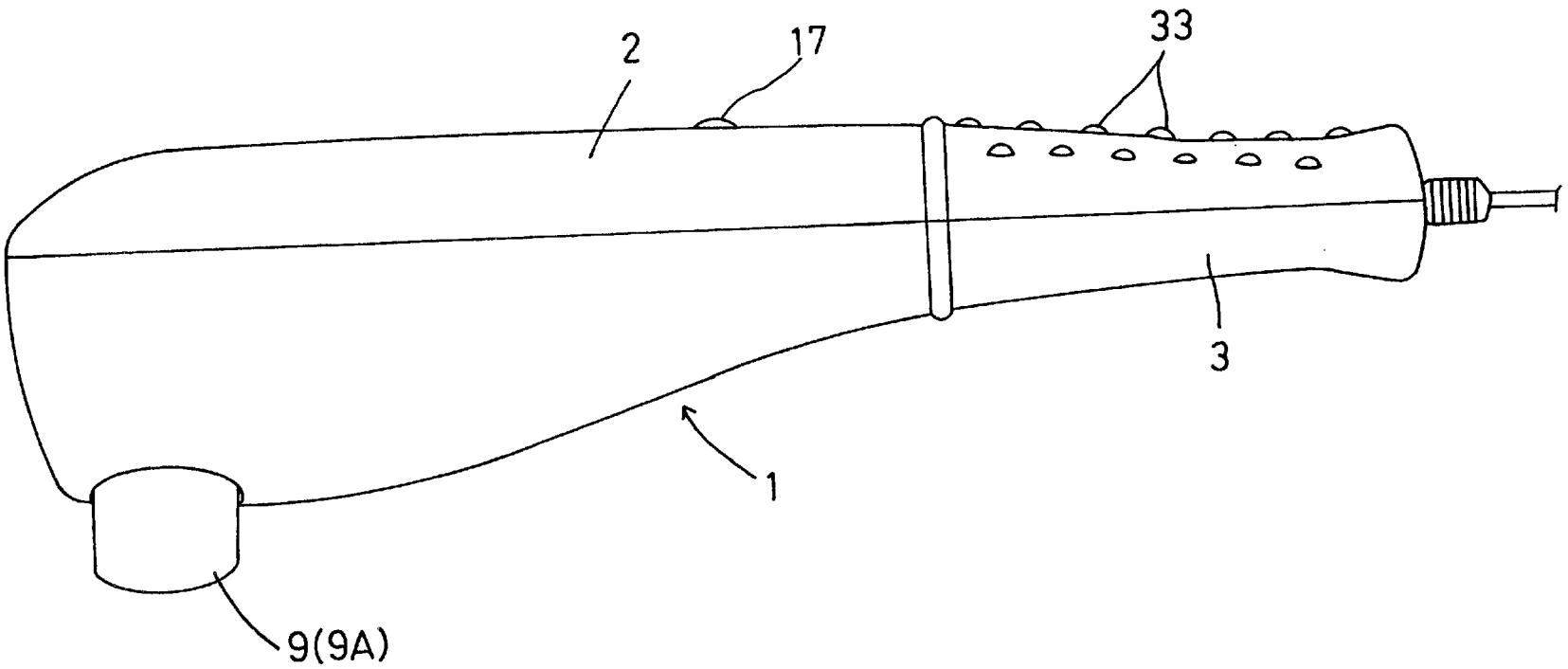
FIG. 4 is a side view showing the entire construction of another embodiment of a hand-carriable massage device of the present invention.
Figure 5:
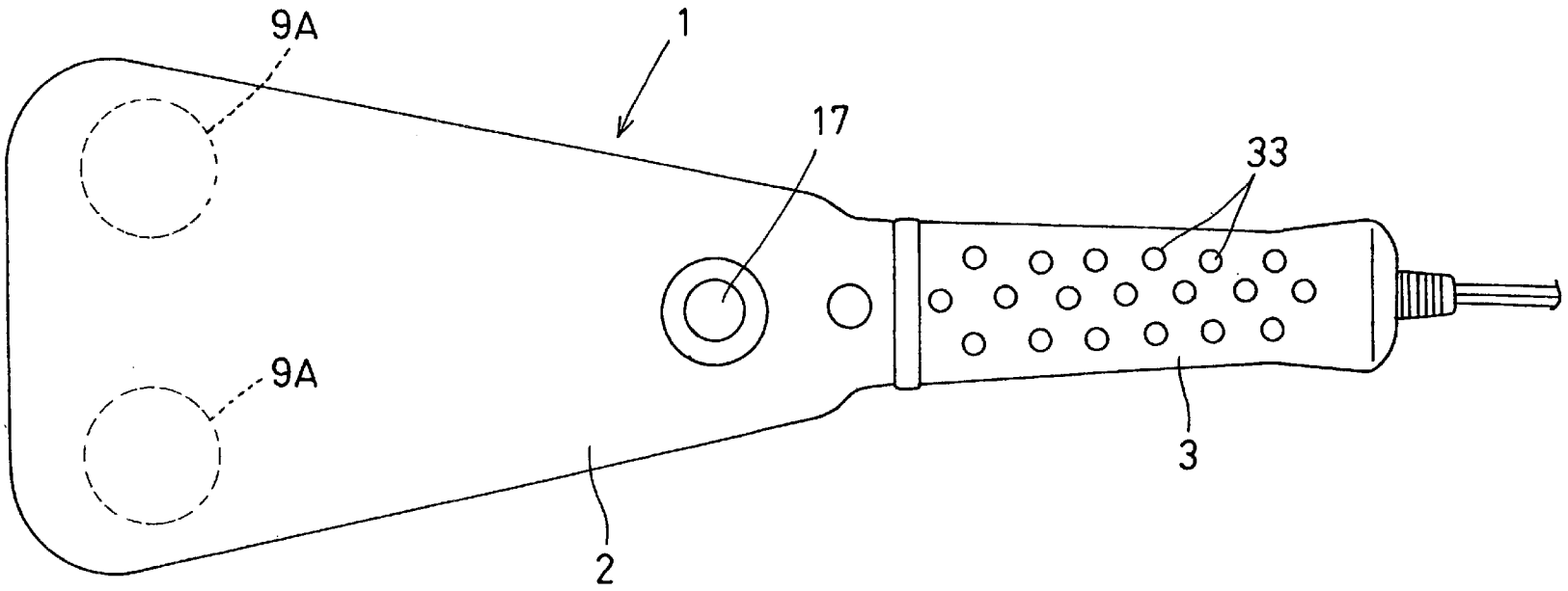
FIG. 5 is a plan view of the hand-carriable massage device shown in FIG. 4.

Design of the external appearance of the massage device 1 is not limited to that shown in FIG. 1, and housing 2 as shown in FIGS. 4 and 5 may be used. Such housing 2 has a grip 3 formed with protrusions 33 for preventing slip.

FIGS. 6 to 10 illustrate an embodiment of stationary type massage device 51 containing a tapping-type massaging mechanism 51A according to the present invention.

Figure 6:
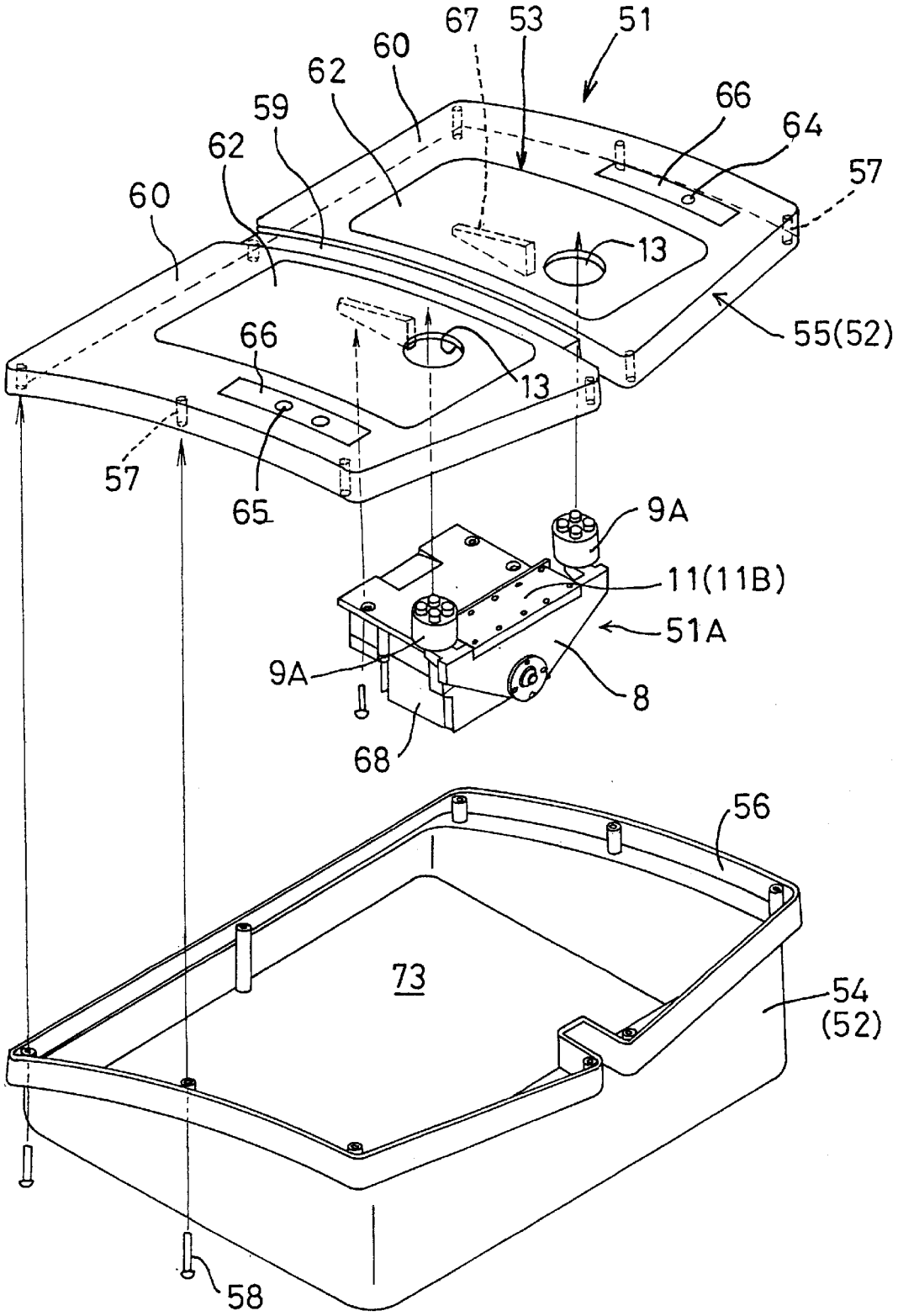
FIG. 6 is an exploded perspective view showing a stationary type massage device embodying the present invention.

As shown in FIG. 6, the stationary type massage device 51 comprises a stationary-type housing 52 having a foot rest surface 53 and an opening 13 on its top and the tapping-type massaging mechanism 51A contained in the housing 52.

As in the foregoing embodiment, the tapping-type massaging mechanism 51A includes an AC drive motor 4 contained in the housing 52, a counterbalance 6 secured to output shaft 5 of the drive motor 4, a crank mechanism 7 mounted to the counterbalance 6, and a vibrating plate 8 attached to the crank mechanism 7 for rotation relative thereto.

The tapping-type massaging mechanism 51A further includes a massaging member 9 mounted on the vibrating plate 8 and projecting out of the housing 52, a support plate 10 secured to a surface of the drive motor 4 on the output shaft 5 side, and an elastic connecting member 11 interposed between the support plate 10 and the vibrating plate 8 so as to interconnect the plates 8 and 10 and allow the vibrating plate 8 to reciprocate.

Since the internal structure of the tapping-type massaging mechanism 51A of the stationary type massage device 51 is substantially the. same as that of the hand-carriable massage device, characteristic features of the stationary type massage device 51 will be mainly described, and like reference numerals are used to designate like or corresponding parts throughout the hand-carriable type and stationary type massage devices so as to omit the detailed description of such parts.

As shown in FIG. 6, the stationary type housing 52 comprises an open top housing body 54 and a lid 55 having foot rest surface 53 and openings 13 on its top. The housing body 54 is provided with a fitting frame 56 on the open top thereof which has a figure corresponding to the contour of the lid 55 for receiving the lid 55 from above.

The lid 55 is formed with threaded holes 57 along the peripheral edge thereof. The lid 55 is fixed to the housing body 54 to close the open top of the housing body 54 by screwing setscrews 58 extending through the fitting frame 56 from below into the threaded holes 57 of the lid 55.

The lid 55 includes a pair of right and left foot rest plates 60 separated by a central groove 59, each of which includes one of the openings 13 and is affixed with a mat 62 formed of rigid resin and having a multiplicity of massaging protrusions 61 on the surface thereof. The right and left foot rest plates 60 are each sized slightly greater than an average size of a human foot to form the foot rest surface 53 on the top of the housing 51.

The upper surface of each massaging head 9A is formed with massaging protrusions 63 having the same shape as those formed on the foot rest plates 60.

Adjacent right and left lateral ends of the top surface of the lid 55 is provided a control panel 66 having an electric power switch 64, a tapping speed selection switch 65 and the like. Adjacent the widthwise center of the underside of the lid 55 are provided mounting walls 67 for mounting the massaging mechanism 51A in a suspended fashion.

As shown in FIGS. 7 to 10, the drive motor 4 is contained in a motor casing 68 comprising an upper first cover 69 and a lower second cover 70. The drive motor 4 is interposed between the covers 69 and 70 and fixedly contained in the motor casing 68 by joining the mating portions of the covers 69 and 70 with setscrews 71.

The first cover 69 is formed integrally with the support plate 10 on the output shaft 5 side (right side in FIG. 7), the support plate 10 movably supporting the vibrating plate 8.

Figure 7:
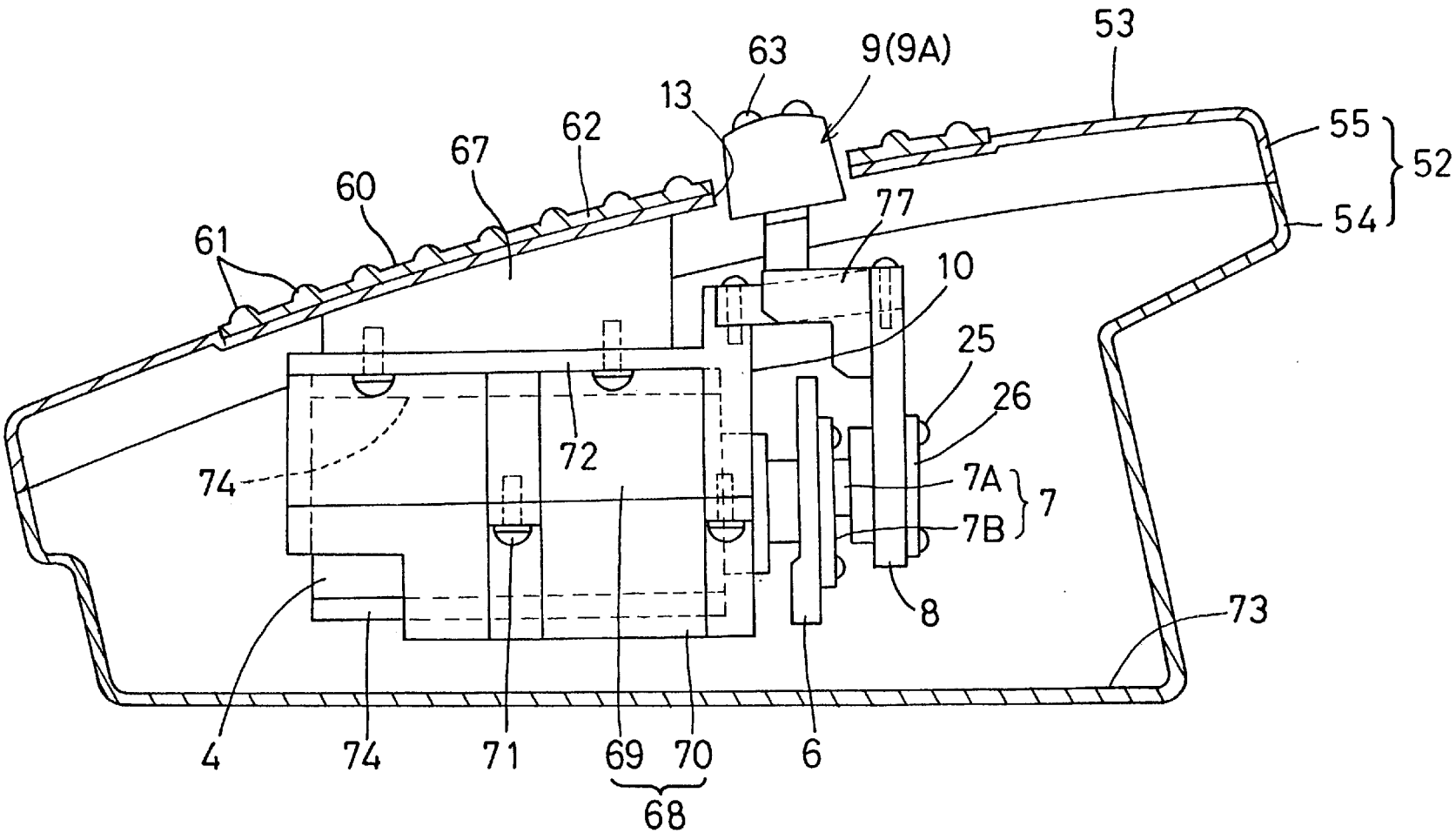
FIG. 7 is a sectional view of the stationary type massage device shown in FIG. 6.
Figure 8:
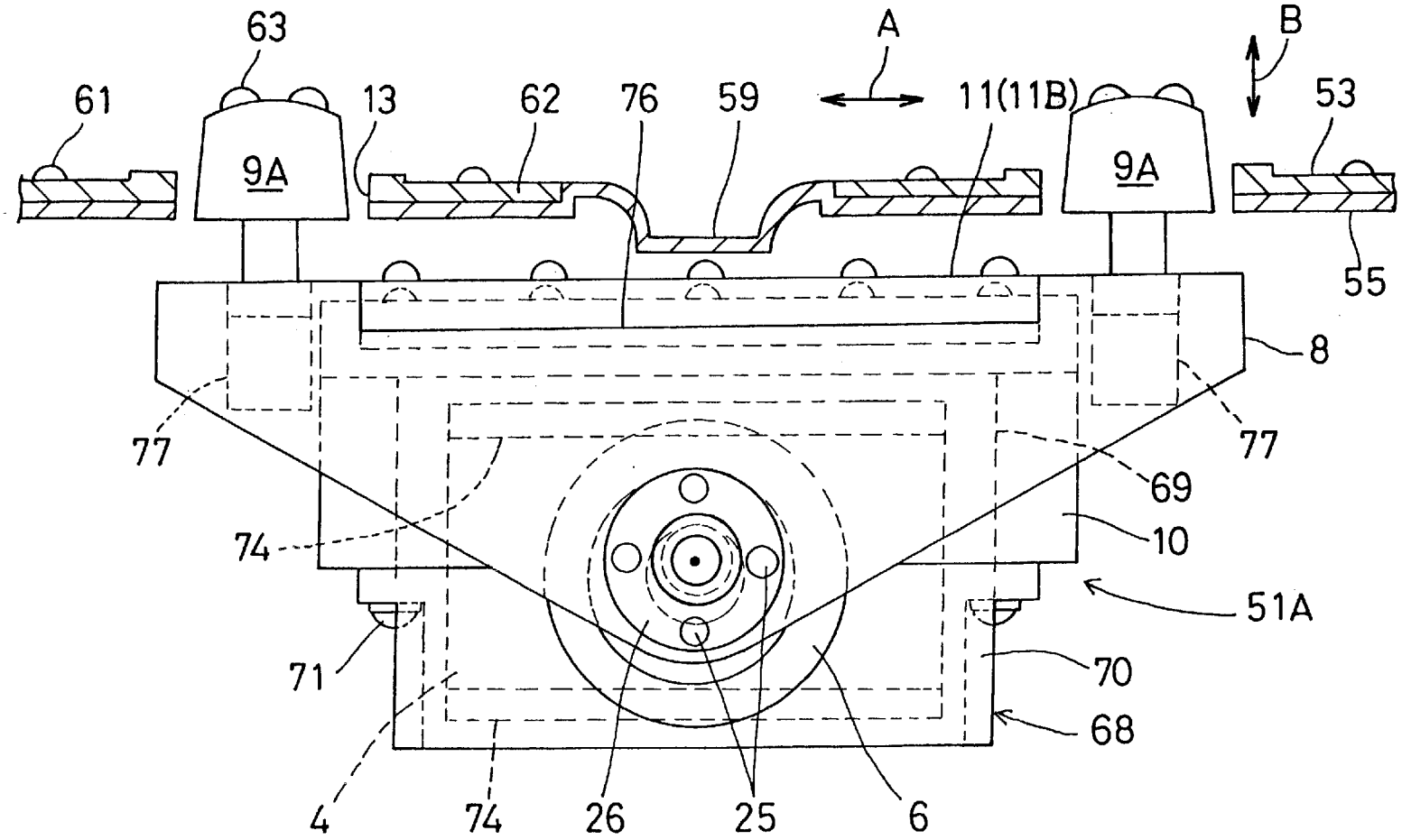
FIG. 8 is a front view showing another embodiment of a tapping-type massaging mechanism contained in the stationary type massage device shown in FIG. 6.

The first cover 69 is formed with mounting flanges 72 on widthwise opposite sides thereof. As shown in FIG. 7, the mounting flanges 72 are fixed to the bottom end surfaces of the mounting walls 67 with screws, so that the tapping-type massaging mechanism 51A is secured to the underside of the lid 55 with the output shaft 5 horizontally oriented and with the mechanism 51A being clear of bottom plate 73 of the housing body 54.

With this arrangement, rebound of the tapping movement of the massaging heads 9A is first transmitted to the lid 55 but not directly transmitted to the bottom plate 73 of the housing body 54, thereby inhibiting the housing 52 from leaping on the floor as much as possible during the tapping operation.

The massaging heads 9A are positioned so as to project through the openings 13 of the lid 55 beyond the foot rest surface 53 when the motor casing 68 is secured to the lid 55.

Between the drive motor 4 and each of the covers 69 and 70 of the motor casing 68 are interposed shock-absorbing sheets 74 formed of rubber, foamed resin or the like so that the vibration of the output shaft 5 is prevented from being transmitted through the motor directly to the motor casing 68.

Figure 9:
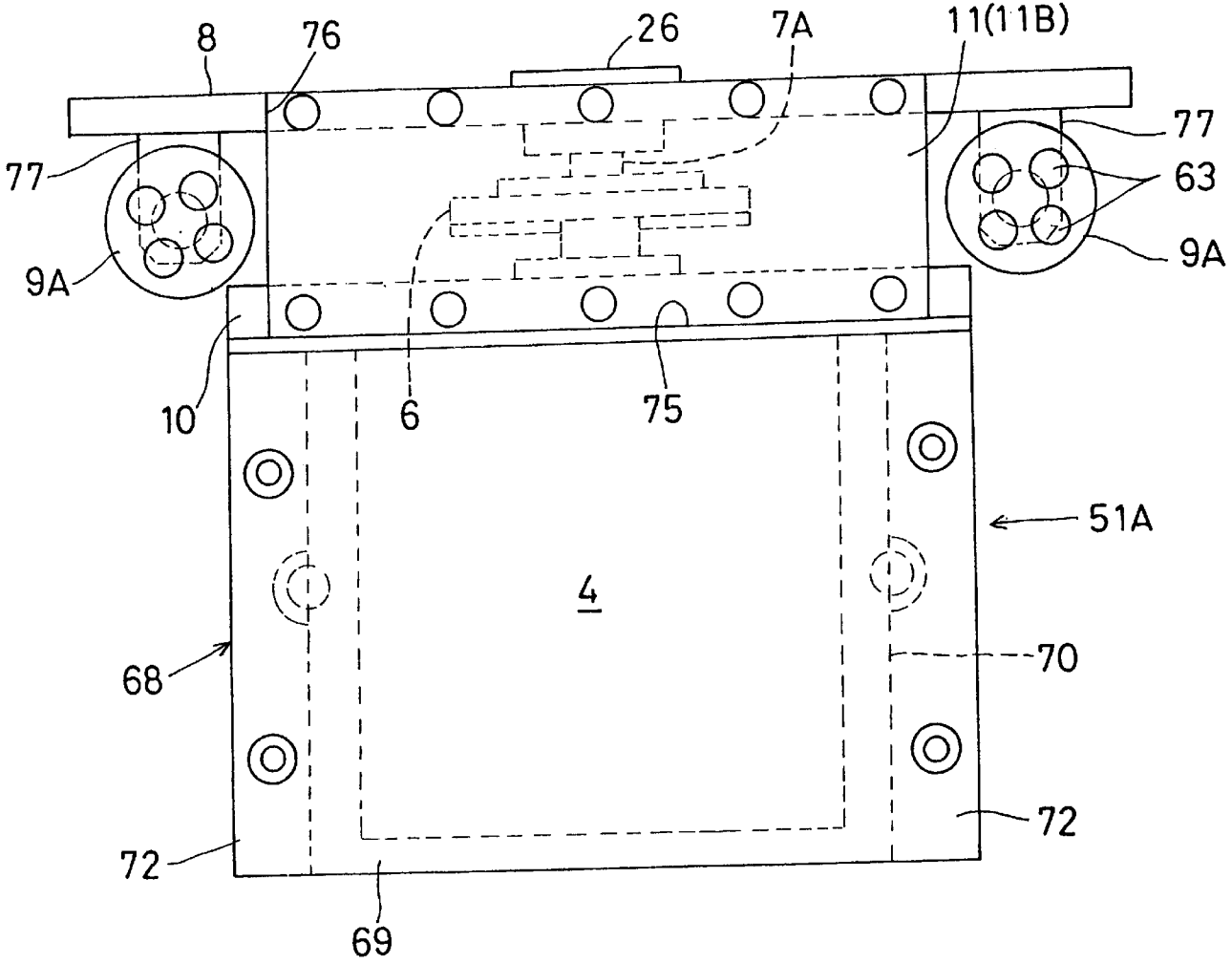
FIG. 9 is a top plan view of the tapping-type massaging mechanism shown in FIG. 8.
Figure 10:
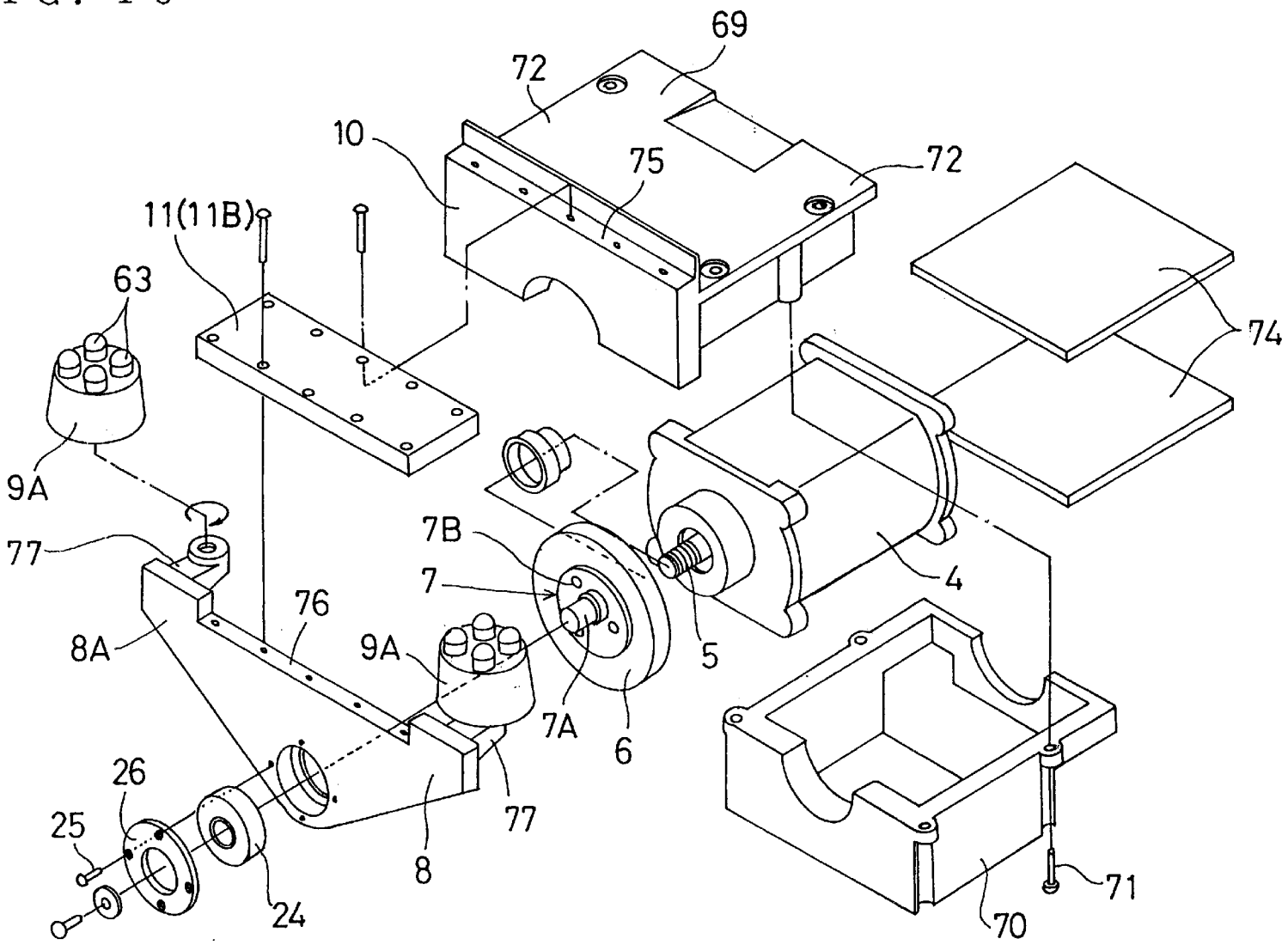
FIG. 10 is an exploded perspective view of the tapping-type massaging mechanism shown in FIG. 8.

The elastic connecting member 11 in this embodiment comprises a relatively thick rectangular flat strip 11B which is elongated in the direction A orthogonal to the tapping direction B of the massaging heads 9A and is formed of natural or synthetic rubber. As shown in FIGS. 9 and 10, the flat strip 11B has one longer edge fixed to a step portion 75 formed in an edge of the support plate 10 with screws, and the opposite edge fixed to cut out recess 76 formed in an edge 8A of the vibrating plate 8.

Thus, also in the tapping-type massaging mechanism 51A of this embodiment, the vibrating plate 8 is connected to the support plate 10 through the rubber strip 11B (elastic connecting member 11) so as to be movable in parallel with and relative to the support plate 10 as in the embodiment of hand-carriable massage device 1.

Since the rectangular strip 11B is readily deformable in the thicknesswise direction thereof (tapping direction B) but hardly deformable in the lengthwise direction (direction A orthogonal to the tapping direction B), portions of the vibrating plate 8 adjacent the massaging head mounting positions are largely movable in the tapping direction B but hardly movable in the direction A orthogonal to the tapping direction B.

Accordingly, this embodiment also allows the openings 13 of the housing 52 for receiving the massaging heads 9A to be formed as small as possible thereby inhibiting foreign particles such as dust from penetrating into the housing 52 as much as possible.

As shown in FIGS. 7 and 9, the vibrating plate 8 of this embodiment is provided at laterally opposite ends thereof with a pair of right and left mounting brackets 77 projecting toward the drive motor 4 side. The massaging heads 9A are removably mounted on the brackets 77 with screws.

For this reason, the massaging heads 9A need not be disposed away from the drive motor 4 (to the right in FIG. 7), thereby making the tapping-type massaging mechanism 51A, as well as the massage device 51 containing the mechanism 51A, compact.

In the above stationary type massage device 51, when the electric power switch 64 is turned ON to operate the drive motor 4, the counterbalance 6 and crank mechanism 7 fixed to the output shaft 5 rotate to cause the crank pin 7A to revolve about the axis of the output shaft 5. Consequently, the vibrating plate 8 vibrates in both the widthwise direction (direction A in FIG. 8) and the vertical direction (direction B in FIG. 8) under the restriction of the elastic connecting member.

This results in vibration of the massage heads 9A mounted on the mounting bracket 77 of the vibrating plate 8 in the same directions as that of the vibrating plate 8, i.e., in both the tapping direction B and the direction A orthogonal to the tapping direction B.

When a user's feet are placed on the right and left foot rest plates 60,60 to abut against the right and left massaging heads 9A,9A moving in the tapping direction B, the soles of the feet are tapped from below by the massaging heads 9A, 9A thus producing an enjoyable comfortable massage.

The massaging device 51 can massage not only feet but also calves or legs and other portions of a human body by placing such portions to be massaged on the foot rest plates 60,60. The tapping force can be varied by operating the switch 65 on the control panel 66.

Figure 11:
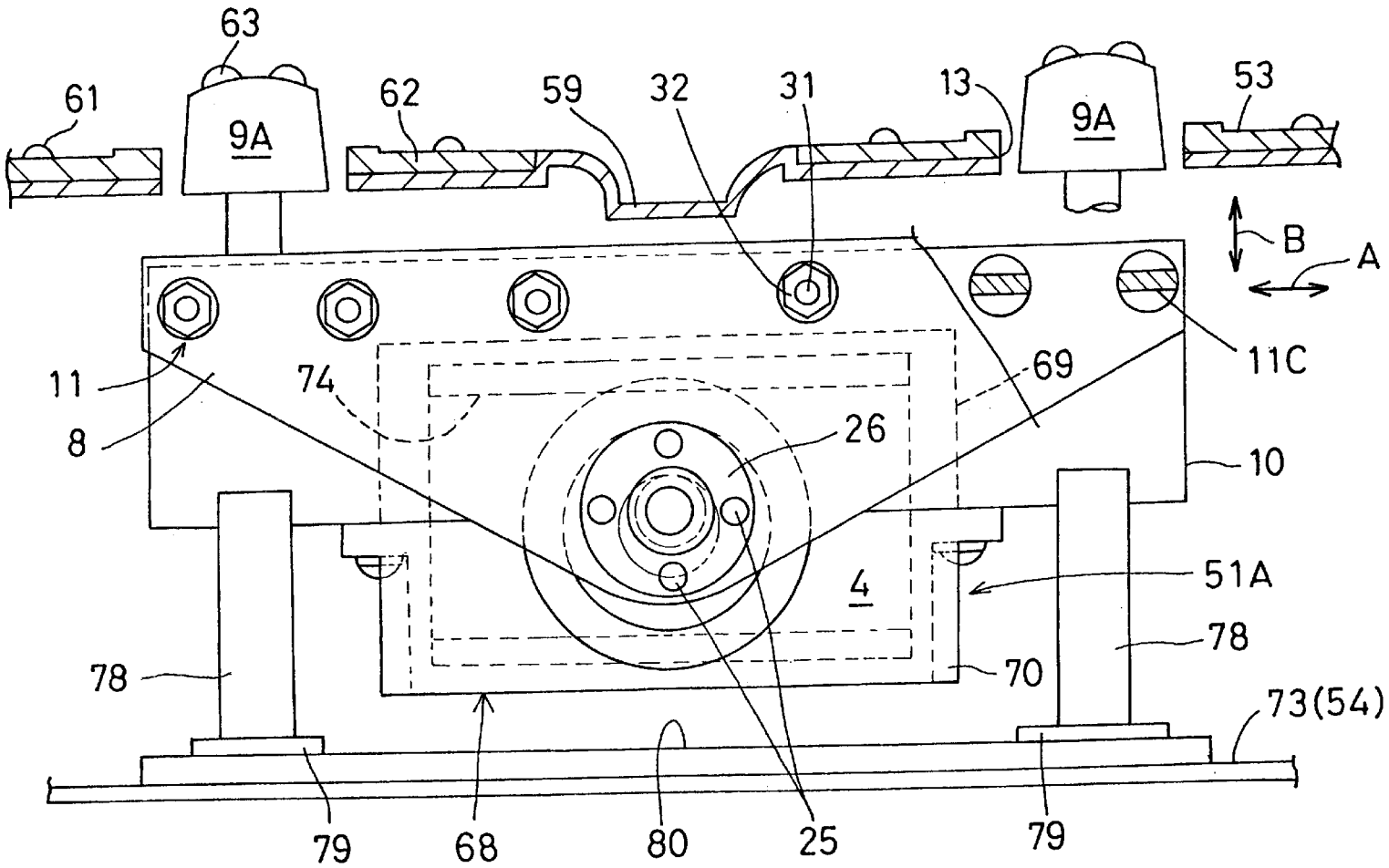
FIG. 11 is a front view showing another embodiment of a tapping-type massaging mechanism contained in the stationary type massage device of FIG. 6.

FIG. 11 illustrates another embodiment of tapping-type massaging mechanism 51A contained in the stationary type massage device 51.

This embodiment differs from the embodiment shown in FIGS. 6 to 10 in that elastic connecting member 11 comprises a plurality of flat columns 11C instead of single strip 11B.

As shown in FIG. 11, six rubber flat columns 11C are used as the elastic connecting member 11 and aligned substantially linearly in the direction A orthogonal to the tapping direction B of the massaging heads 9A like the arrangement shown in FIG. 2.

Figure 12:
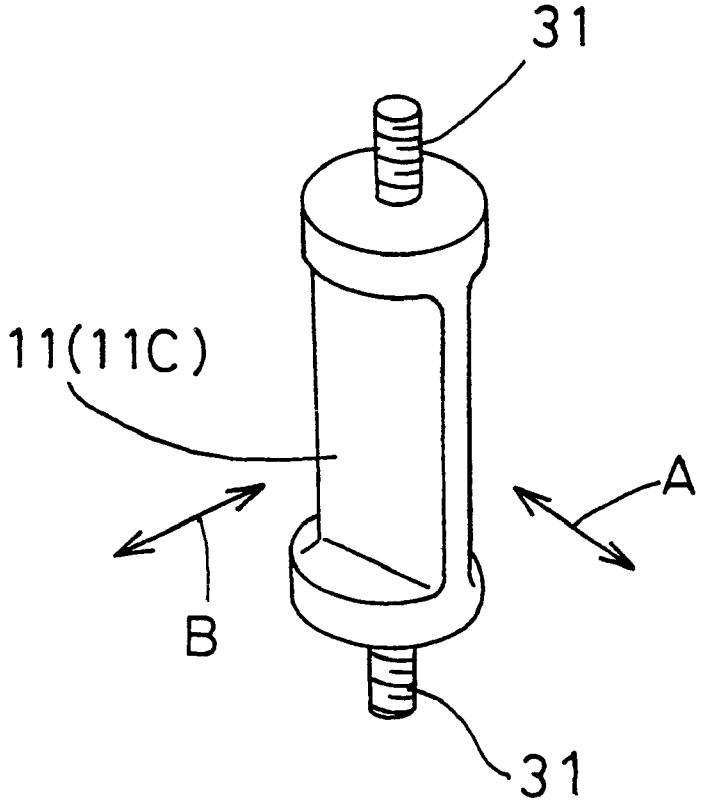
FIG. 12 is a perspective view showing an elastic connecting member comprising a flat column.

Each flat column 11C is, as shown in FIG. 12, provided with mounting screws 31 at longitudinally opposite ends and formed flat at a longitudinally central portion thereof, such that the thickness of the flat portion in the tapping direction B of the massaging heads 9A is smaller than that in the direction A orthogonal to the tapping direction B.

Consequently, compared to the columnar members 11A, having a simple circular cross section, the columns 11C allow portions of the vibrating plate 8 adjacent the massaging heads 9A to move more easily in the tapping direction B while restraining the movement thereof in the direction A orthogonal to the tapping direction B as much as possible.

The flat columns 11C shown in FIG. 12 may be used in the massaging mechanism 1A shown in FIG. 3 to be contained in the hand-carriable massage device 1. The elongate strip 11B may also be used in the massaging mechanism 1A shown in FIG. 3 to be contained in the hand-carriable massage device 1.

As shown in FIG. 11, the support plate 10 is supported by support columns 78 at the right and left ends thereof for enhancing the support of the tapping-type massaging mechanism 51A. The support columns 78 are disposed on widthwise positions of the support plate 10 corresponding to the massaging head mounting positions of the vibrating plate 8 and each provided with a shock-absorbing rubber disc 79 on the bottom end surface thereof. The shock-absorbing rubber disc 79 is mounted on an elongate shock-absorbing rubber strip 80 bonded to the bottom plate 73 of the housing body 54.

While the tapping-type massaging mechanism 51A mounted clear of the housing body 54 may have an insufficient mounting strength, hence a reduced durability, the massaging mechanism 51A according to this embodiment is supported also by the support columns 78 to ensure an increased mounting strength. Since the support columns 78 are mounted on the bottom plate 73 of the housing body 54 through the shock-absorbing members 79 and 80, the stationary-type housing 52 is prevented from leaping on the floor during massaging operation.

Further, since the right and left support columns 78 are each disposed on a widthwise position of the support plate 10 corresponding to the massaging head mounting position of the vibrating plate 8, the support plate 10 is directly supported by the support columns 78 at areas which are most susceptible to the rebound of the tapping operation thereby utilizing the shock-absorbing effect of the shock-absorbing members 79 and 80 more effectively. It is noted that any one of the shock-absorbing disc 79 and the shock-absorbing strip 80 may be omitted.

As described above, the present invention provides a massage device which allows its massaging member to perform tapping movement without pivotally mounting the vibrating plate directly to the housing and without the necessity of any crank rod. Such a massage device enjoys enhanced durability and requires reduced manufacturing costs.

While only presently preferred embodiments of the present invention have been described in detail, as will be apparent with those familiar with the art, certain changes and modifications can be made in embodiments without departing from the spirit and scope of the present invention as defined by the following claims.

What is claimed is:

1. A tapping-type massaging mechanism comprising:

a drive motor;

a support plate secured to the drive motor so as to extend radially outwardly of the motor;

a crank pin eccentrically secured to an output shaft of the drive motor;

an elastically deformable connecting member secured to the support plate at one end thereof so as to extend in the same direction as the output shaft;

a vibrating plate secured to the other end of the connecting member so as to be movable relative to and in parallel with the support plate, the vibrating plate receiving therethrough the crank pin for rotation; and a tap-massaging member mounted on an end of the vibrating plate so as to orient toward a first direction orthogonal to the output shaft;

wherein the tap-massaging member is adapted to tap primarily in the first direction orthogonal to the output shaft, due to the elastically deformable connecting member allowing movement of vibrating plate relative to the support plate in the first direction with little resistance while inflicting substantially more resistance to movement of the vibrating plate in a second direction orthogonal to the first direction and orthogonal to the output shaft.

2. The tapping-type massaging mechanism of claim 1, wherein said crank pin is inserted through a ball bearing provided in the vibrating plate.

3. The tapping-type massaging mechanism of claim 2, wherein: said tap-massaging member comprises a pair of right and left massaging heads; the crank pin extends through the vibrating plate centrally of the width of the vibrating plate; and the pair of right and left massaging heads are oriented in a same direction and disposed on opposite sides of the vibrating plate in a widthwise direction of the vibrating plate so as to be spaced substantially equidistantly from the point of the vibrating plate through which the crank pin extends.

4. The tapping-type massaging mechanism of claim 3, wherein said elastically deformable connecting member comprises a plurality of columnar members linearly disposed in the second direction.

5. The tapping-type massaging mechanism of claim 4, wherein said plurality of columnar members each have a smaller thickness in the first direction than in the second direction.

6. The tapping-type massaging mechanism of claim 3, wherein said elastically deformable connecting member comprises an elongate strip member having a longer side in the second direction and a shorter side in the first direction.

7. The tapping-type massaging mechanism of claim 4, wherein any one of said plurality of columnar members is disposed at a widthwise position of the vibrating plate corresponding to the massaging head mounting position of the vibrating plate.

8. The tapping-type massaging mechanism of claim 3, wherein said massaging heads are detachably secured to said vibrating plate.

9. The tapping-type massaging mechanism of claim 3, wherein said massaging heads are each secured to the vibrating plate through a mounting bracket extending away from the vibrating plate and toward the drive motor.

10. A hand-carriable massage device comprising a housing having one end forming a grip and the other end defining an opening; and a tapping-type massaging mechanism contained in the housing, the tapping-type massaging mechanism comprising:

a drive motor;

a support plate secured to the drive motor so as to extend radially outwardly of the motor;

a crank pin eccentrically secured to an output shaft of the drive motor;

an elastically deformable connecting member secured to the support plate at one end thereof so as to extend in the same direction as the output shaft;

a vibrating plate secured to the other end of the connecting member so as to be movable relative to and in parallel with the support plate, the vibrating plate receiving therethrough the crank pin for rotation; and a tap-massaging member inserted through the opening of the housing and mounted on an end of the vibrating plate so as to orient toward a direction orthogonal to the output shaft.

11. A stationary type massage device comprising a stationary-type housing having a foot rest surface and an opening on its top; and a tapping-type massaging mechanism contained in the housing, the tapping-type massaging mechanism comprising:

a drive motor having a horizontally extending output shaft;

a support plate vertically secured to the drive motor so as to extend radially outwardly of the motor;

a crank pin eccentrically secured to the output shaft of the drive motor;

an elastically deformable connecting member secured to the support plate at one end thereof so as to extend in the same direction as the output shaft;

a vibrating plate secured to the other end of the connecting member so as to be movable relative to and in parallel with the support plate, the vibrating plate receiving therethrough the crank pin for rotation; and a tap-massaging member inserted through the opening of the housing so as to upwardly project beyond the foot rest surface and secured to an end of the vibrating plate so as to orient toward a direction orthogonal to the output shaft.

12. The massage device of claim 11, wherein said housing comprises a housing body having an open top and a lid, the lid closing the open top of the housing body, and the tapping-type massaging mechanism is secured to an underside of the lid so as to be clear of a bottom of the housing body.

13. The massage device of claim 12, wherein a support column is fixed to said support plate of the tapping-type massaging mechanism, the support column extends down to the bottom of the housing body and includes a shock-absorbing member.

14. The massage device of claim 13, wherein said support column is disposed at a position of the support plate corresponding to the massaging head mounting position in a widthwise direction of the vibrating plate.

* * * * *